US010876380B2

(12) United States Patent
Van Dongen et al.

(10) Patent No.: US 10,876,380 B2
(45) Date of Patent: Dec. 29, 2020

(54) SEALING A BORE OR OPEN ANNULUS

(71) Applicant: Maersk Olie og Gas A/S, Copenhagen (DK)

(72) Inventors: Hans Johannes Cornelius Maria Van Dongen, Copenhagen (DK); Hans-Henrik Kogsboll, Gentofte (DK)

(73) Assignee: MAERSK OLIE OG GAS A/S, Copenhagen K (DK)

( * ) Notice: Subject to any disclaimer, the term of this patent is extended or adjusted under 35 U.S.C. 154(b) by 0 days.

(21) Appl. No.: 14/898,872

(22) PCT Filed: Jun. 9, 2014

(86) PCT No.: PCT/EP2014/061940
§ 371 (c)(1),
(2) Date: Dec. 16, 2015

(87) PCT Pub. No.: WO2014/202419
PCT Pub. Date: Dec. 24, 2014

(65) Prior Publication Data

US 2016/0123122 A1 May 5, 2016

(30) Foreign Application Priority Data

Jun. 17, 2013 (GB) ..... 1310742

(51) Int. Cl.
*E21B 17/00* (2006.01)
*E21B 29/00* (2006.01)
(Continued)

(52) U.S. Cl.
CPC ..... *E21B 43/105* (2013.01); *E21B 17/00* (2013.01); *E21B 29/00* (2013.01); *E21B 29/02* (2013.01); *E21B 43/108* (2013.01)

(58) Field of Classification Search
None
See application file for complete search history.

(56) References Cited

U.S. PATENT DOCUMENTS 3,167,122 A * 1/1965 Lang ..... E21B 29/10 138/97
4,507,019 A 3/1985 Thompson
(Continued)

FOREIGN PATENT DOCUMENTS

EP 0207030 A1 12/1986
GB 2167156 A 5/1986
(Continued)

OTHER PUBLICATIONS

International Search Report PCT/ISA/210 for International Application No. PCT/EP2014/061940 dated Nov. 13, 2014.
(Continued)

*Primary Examiner* — Matthew R Buck
*Assistant Examiner* — Douglas S Wood
(74) *Attorney, Agent, or Firm* — Harness, Dickey & Pierce, P.L.C.

(57) ABSTRACT

Disclosed is a method for use in restricting or sealing a bore. A tubular is expanded in the bore to cause the tubular to split and be extended towards a wall of the bore. A straddle is located within the tubular so as to extend across the region of the tubular which has been split, and expanded to seal the split in the tubular. Also disclosed is apparatus comprising one or more expansion tools and a straddle, for use in sealing or restricting a bore. The apparatus may be used in conjunction with a tubular as disclosed herein, having one or more weak zones adapted to preferentially split under the action of an expansion tool.

23 Claims, 16 Drawing Sheets

(51) Int. Cl.
*E21B 29/02* (2006.01)
*E21B 43/10* (2006.01)

(56) References Cited

U.S. PATENT DOCUMENTS

| | | | | |
|---|---|---|---|---|
| 4,696,606 | A | 9/1987 | Herron | |
| 4,767,236 | A | 8/1988 | Rice | |
| 6,253,850 | B1 * | 7/2001 | Nazzai | E21B 43/086 166/277 |
| 6,412,565 | B1 * | 7/2002 | Castano-Mears | E21B 43/086 166/230 |
| 6,588,983 | B1 | 7/2003 | Tenbusch, II | |
| 7,121,351 | B2 * | 10/2006 | Luke | E21B 29/10 166/382 |
| 7,124,821 | B2 | 10/2006 | Metcalfe et al. | |
| 7,401,647 | B2 * | 7/2008 | Baycroft | E21B 29/10 138/98 |
| 7,798,223 | B2 | 9/2010 | Duggan et al. | |
| 7,832,477 | B2 * | 11/2010 | Cavender | E21B 43/26 166/206 |
| 8,978,776 | B2 * | 3/2015 | Spray | E21B 43/108 166/207 |
| 2006/0042801 | A1 | 3/2006 | Hackworth et al. | |
| 2006/0076147 | A1 | 4/2006 | Ring | |
| 2007/0000664 | A1 | 1/2007 | Ring et al. | |
| 2008/0283253 | A1 * | 11/2008 | Buytaert | E21B 17/1028 166/381 |
| 2010/0038076 | A1 | 2/2010 | Spray et al. | |

FOREIGN PATENT DOCUMENTS

| | | | |
|---|---|---|---|
| WO | WO-92/13226 | A1 | 8/1992 |
| WO | WO-2007/106429 | A2 | 9/2007 |
| WO | WO-2012/140512 | A1 | 10/2012 |
| WO | WO-2013/048371 | A1 | 4/2013 |

OTHER PUBLICATIONS

Written Opinion of the International Searching Authority PCT/ISA/237 for International Application No. PCT/EP2014/061940 dated Nov. 13, 2014.

* cited by examiner

SEALING A BORE OR OPEN ANNULUS

CROSS-REFERENCE TO RELATED APPLICATIONS

This application is a national phase under 35 U.S.C. § 371 of PCT International Application No. PCT/EP2014/061940 which has an International filing date of Jun. 9, 2014, which claims priority to United Kingdom Patent Application No. 1310742.0, filed Jun. 17, 2013, the entire contents of each of which are hereby incorporated by reference.

FIELD OF THE INVENTION

The present invention relates to a method for restricting or sealing an annulus, and in particular to sealing or restricting an open annulus around a tubular in a bore.

BACKGROUND TO THE INVENTION

It is a common requirement in the field of oil and gas production to restrict or isolate a bore or an annulus. For example, in a producing well, it may be required to seal a region suffering from water breakthrough, or during drilling operations or artificial lift operations, it may be required to isolate porous rock formations into which fluids are lost.

A known method for sealing or restricting fluid flow through an annulus is to run a packing tool into a bore, which can be expanded so as to provide a seal. However, there is a limit to the amount by which a packing tool is able to expand. In addition, packing tools cannot be run into a tubular to seal around that tubular, as might be required to isolate a part of a producing well suffering from water breakthrough, for example.

It is also known to seal a bore by injecting a sealing substance such as concrete or epoxy through perforations in a tubular. However, using injection methods, it may be difficult to control where the sealant flows, and only limited control may be possible over the amount of sealant injected or the part of an annulus which is sealed. It is also known for injected sealant to leak into rock formations and fail to seal the bore, or for sealant to be eroded or washed away by flow regimes.

SUMMARY OF THE INVENTION

According to a first aspect of the invention, there is provided a method for use in restricting or sealing a bore, comprising:

- expanding a tubular which is located in the bore to cause the tubular to split and be extended towards a wall of the bore;
- locating a straddle within the tubular which extends across the region of the tubular which has been split; and
- expanding the straddle to seal the split in the tubular.

The method may comprise expanding a tubular which is located in a bore to cause the tubular to split and be extended into engagement with a wall of the bore. Accordingly, the method may provide for sealing a bore.

The bore may be a well bore, or the bore may be defined by a casing, liner or a further tubular. The tubular may be located within an open bore such that tubular member is extended towards or into engagement with the face of the open bore. The method may comprise expanding a tubular into compliant engagement with a bore (such as an eccentric bore).

The method may provide for sealing of the annulus between the tubular and the bore such that fluid flow along said annulus is prevented or restricted.

The method may comprise splitting a length of the tubular. The method may comprise causing the tubular to split axially, or generally axially along a length of the tubular.

The tubular may be split along all, or a part of the region which is expanded. For example, a region of the tubular which has been expanded and split may extend at each end to transitional regions of the tubular which have been expanded and which have not been split (which may each extend in turn to a region of the tubular which has not been expanded or split).

The tubular may comprise a single tubular member or may comprise a tubing string formed of multiple tubular members connected together end-to-end.

The tubular may be perforated. The perforations may be slots and the tubular may comprise slotted tubing. The tubular may, for example, comprise production tubing, sand screen, or tubing for wellbore stimulation, such as controlled acid jet (CAJ) liner.

The method may comprise restricting or sealing the bore and sealing one or more perforations in the tubular.

The method may comprise locating an expansion tool within the tubular and using the expansion tool to expand and axially split the tubular.

At least a portion of the expansion tool may be configured to radially expand, so as to expand and split the tubular.

At least a portion of the expansion tool may be configured to radially contract, following expansion. The expansion tool may be a reusable expansion tool, for example to remove the expansion tool from, or reposition the expansion tool within the tubular.

An expandable portion of the tool may be adapted to comply with the internal profile of the tubular.

The expansion tool may be configured to limit the extension of the tubular.

The expandable portion may be operable to radially expand to a predetermined circumference.

The expansion tool may comprise a reinforcing structure configured to provide reinforcement to an expandable portion, such as a bladder. The reinforcing structure may be configured to limit expansion of the expandable portion. The reinforcing structure may surround the expandable portion.

The reinforcing structure may include protection from tearing or perforation of the bladder.

The expansion tool may be expanded to cause the tubular to split and be extended into engagement with a casing or another tubular, and the reinforcing structure may be configured to limit expansion so as not to expand and/or split the casing or other tubular.

The expandable portion may comprise a bladder and the method may comprise inflating the bladder to cause expansion, splitting and extension of the tubular. The bladder may be expanded hydraulically. The expansion tool may be as described in co-pending international application WO 2012/140512.

The expansion tool may comprise an explosive charge, to be detonated and cause expansion and splitting of the tubular. The explosive charge may be detonated to cause expansion of an expandable portion of the expansion tool, such as a bladder.

The method may comprise locating a straddle which extends across the region of the tubular which has been split. The method may comprise locating a straddle which extends across the region of the tubular which has been split and across transitional regions of the tubular which has been expanded but not split.

The method may comprise expanding the straddle so as to seal perforations within the tubular. The straddle may, for example, provide for sealing of perforations in the tubular to prevent fluids by-passing the expanded and sealed section by flowing into the tubular on one side of the expanded portion and exiting back into the bore on the other side of the tubular.

The method may comprise using a bladder of an expansion tool as a straddle, by expanding the bladder with a settable medium (such as epoxy or cement) and setting the settable medium.

The method may comprise locating an expansion tool within a tubular, which extends across a region of the tubular which has been split; and expanding the expansion tool (e.g. by expanding a bladder with a settable medium) to seal the split in the tubular.

The bladder may be provided with a cylindrical member extending therethrough. The cylindrical member may function as a conduit for injecting a settable medium into the bladder (e.g. via perforations in the cylindrical member) and/or the cylindrical member may function to guide drilling through the bladder.

The method may comprise locating the straddle within the tubular, extending across the region of the tubular which has been split, using an expansion tool.

The method may comprise locating a straddle positioned around an expansion tool and using the expansion tool to expand the straddle and seal the split in the tubular.

The expansion tool used to expand the straddle may be the expansion tool used to expand and split the tubular. The method may comprise expanding and splitting the tubular with a first expansion tool, locating a second expansion tool across the region of the tubular which has been split and expanding the second expansion tool to seal the split in the tubular.

The method may comprise providing a sealing arrangement between the straddle and the tubular. The straddle may comprise a sealing arrangement around and along some or all of the length of the straddle. The sealing arrangement may, for example, comprise a deformable or an elastomeric coating, or a coating of a sealant.

The straddle may be expanded to extend through the axial split in the tubular to engage the bore wall.

The method may be performed in a bore which is producing or in which production has been temporarily ceased e.g. in order for well stimulation or injection to take place.

The method may be used to restrict or seal a bore having a substantially larger diameter than the tubular. The diameter of the bore wall may be at least 25% or at least 50% larger than the unexpanded tubular. The diameter of the bore may be up to twice as large as the unexpanded tubular.

The method may comprise splitting a tubular along a weak zone, and/or expanding the tubular by bending around and along a predefined zone of deformation.

The weak zone may comprise a frangible portion. The predefined zone of deformation may comprise a living hinge. The weak zone and predefined zone of deformation may focus splitting and deformation of the tubular respectively, which facilitates predictable splitting and expansion of the tubular.

The method may comprise providing a tubular with a predefined zone of deformation and/or a weak zone. The method may comprise providing a tubular with a weak zone and/or a predefined zone of deformation in situ.

The method may comprise weakening a zone of the tubular, and subsequently splitting the tubular along the weak zone.

A weak zone and/or a predefined zone of deformation may be provided by use of a perforation tool, cutting tool or the like.

The method may comprise providing a region of reduced wall thickness of the tubular, for example a line or a pattern of cavities or slots.

The method may comprise splitting a tubular along and beyond a weak zone. Accordingly a weak zone may provide a starting point for a split in the tubular.

A length of the tubular may comprise more than one weak zone and/or more than one predefined zone of deformation.

A length of the tubular may comprise more than one weak zone circumferentially spaced apart and/or axially spaced apart. A length of tubular may comprise weak zones which are on diametrically opposite sides of the tubular.

The method may comprise splitting a length of the tubular into fragments and extending the fragments into engagement with a wall of the bore.

The method may comprise retaining the fragments in engagement with the wall of the bore, and/or so as to prevent fragments from falling into the annulus around the tubular or into the tubular, for example by one or more bridges or tethers.

The tubular may comprise one or more bridges or tethers.

An expansion tool may comprise or function as a bridge or a tether. For example, expandable portion of an expansion tool may function as a bridge or tether. A bridge or a tether may be positioned around or against an expandable portion of an expansion tool.

The method may comprise detonating an explosive charge so as to inflate a bladder and split a length of the tubular into fragments.

The method may comprise further or intermediate steps, as required, for example to position or reposition an expansion tool and/or the straddle.

According to a second aspect of the invention there is provided use of an expansion tool in restricting or sealing a bore, by expanding a tubular which is located in the bore to cause the tubular to split and be extended towards a wall of the bore. The expansion tool may also be used to expand a straddle which has been positioned so as to extend across the region of the tubular which has been split, so as to seal the split in the tubular. The expansion tool may be used in the method of the first aspect. The invention also extends to use of an expansion tool comprising a bladder as a straddle, by expanding the bladder with a settable medium and setting the settable medium.

According to a third aspect of the invention there is provided apparatus for use in restricting or sealing a bore, the apparatus comprising:

- an expansion tool positionable within a tubular located in the bore, and configured to expand the tubular; and to cause the tubular to split and be extended towards a wall of the bore; and
- a straddle positionable within the tubular and to extend across a region of the tubular split by the expansion tool, the straddle configured to be radially expanded by an expansion tool to seal a split in the tubular.

The apparatus may comprise a first expansion tool, a straddle and a second expansion tool configured to radially expand the straddle.

The straddle may comprise corrugations or folds. The straddle may comprise a leaf arrangement. The straddle may take the form of an expandable bladder.

The apparatus may comprise a downhole tool or a work string, the tool or work string comprising at least one radially expandable portion and at least one straddle.

The apparatus may comprise more than one straddle and/or more than two expansion tools. Thus, the apparatus may be used to expand, split and expand more than one part of a tubular and to expand a straddle to seal each said split.

The apparatus may further comprise a tubular.

The tubular may be provided with one or more weak zones and/or one or more predefined zones of deformation.

The apparatus may comprise an arrangement for weakening a tubular, such as a perforator, or a cutting arrangement.

The apparatus may be used in the method of the first aspect.

According to a fourth aspect of the invention, there is provided a tubular having a weak zone extending axially along at least a part of the length of the tubular, the weak zone adapted to preferentially split under the action of an expansion tool.

When expanded by an expansion tool, the tubular is adapted to split in a predicable manner along the weak zone.

A weak zone may extend parallel to a central axis of the tubular.

A weak zone may extend along the entire length of the tubular.

A weak zone may comprise a frangible region. A weak zone may comprise a region (e.g. a line or a strip) of reduced wall thickness. For example, a weak zone may comprise a line, or a slot pattern, or a series of cavities extending along a length of the tubular and partially through the wall of the tubular.

A weak zone may comprise a series of perforations.

The weak zone may be adapted to fail without exposing sharp edges towards the inside of an expanded and split tubular. Thus, the risk of perforating an expansion tool comprising an inflatable bladder is reduced. For example the tubular may be provided with an internal coating across the weak zone, such as an internal coating of plastics material. In use, the internal coating may deform or flow, so as to cover sharp edges.

The tubular may comprise a region of reduced thickness material extending to either side of the weak zone, which may bend outwardly under the action of an expansion tool.

The tubular may comprise a predefined zone of deformation extending axially along at least a part of the length of the tubular, adapted to deform or bend when the tubular has been split and is further expanded, under the action of an expansion tool.

Bending of a tubular around a predetermined zone of deformation may cause edges of a tubular along the split in the tubular to be pivoted away from each other, and thus away from an expansion tool.

The tubular may comprise both a weak zone and a predefined zone of deformation.

A weak zone and predefined zone of deformation may extend along the same length of tubular. A length of the tubular may comprise more than one weak zone circumferentially spaced apart and/or axially spaced apart. A predefined zone of deformation and weak zone may be diametrically opposite each other along at least a part of the length of the tubular. A length of tubular may comprise weak zones which are diametrically opposite each other.

A length of tubular having circumferentially spaced apart weak zones may comprise one or more weak zones or predetermined zones of deformation extending circumferentially around the tubular (e.g. at the end of the circumferentially spaced apart weak zones).

The tubular may comprise a bridge or a tether extending from a portion of the tubular along a length of the tubular having a weak zone, to a portion of the tubular without a weak zone.

The bridge or tether may comprise a band or mesh secured to a wall (inside or outside of) the tubular.

The tubular may be perforated and may be provided with perforations along some or all of its length. The tubular may, for example, be slotted tubing or a CAJ liner. A weak zone, or a predefined zone of deformation, may for example comprise a series of perforations which are more closely spaced than the perforations away from the said weak zone.

According to a fifth aspect of the invention there is provided a method for weakening a tubular, comprising providing a weak zone extending axially along a part of the length of the tubular.

The method may comprise providing a predefined zone of deformation associated with (e.g. diametrically opposite) the weak zone.

A weak zone and/or a predefined zone of deformation may be provided by reducing the wall thickness of a region of the tubular. The method may comprise running a tool into the tubular, wherein the tool is a chemical, mechanical or hydraulic cutting tool, and reducing the wall thickness of the tubular using the tool.

The weak zone and/or predefined zone of deformation may be provided in a tubular in a bore (e.g. in a wellbore).

Further preferred and optional features of each aspect of the invention correspond to preferred and optional features of any other aspect of the invention.

DESCRIPTION OF THE DRAWINGS

Example embodiments of the invention will now be described with reference to the following figures in which.

DETAILED DESCRIPTION OF EXAMPLE EMBODIMENTS

Figure 1:
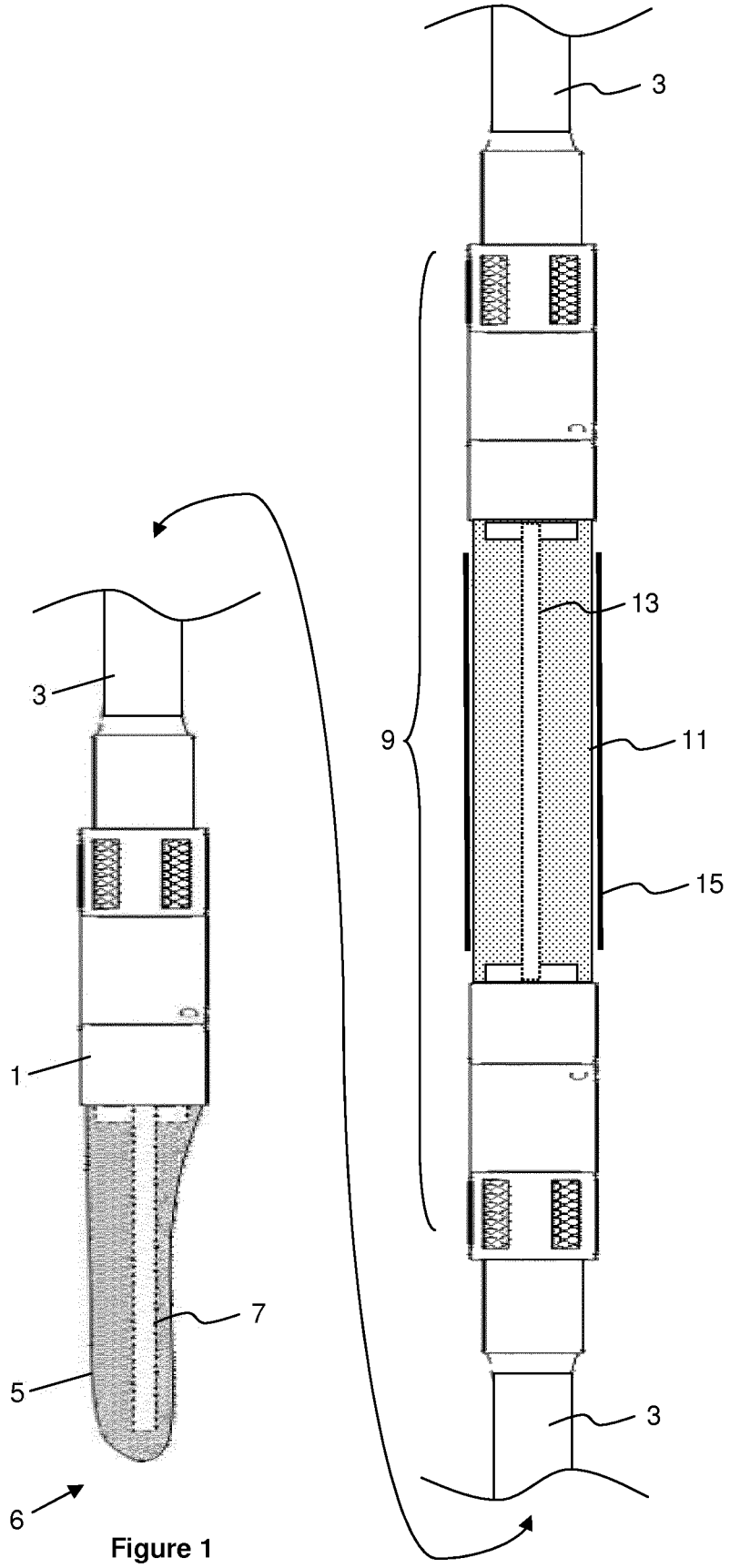
FIG. 1 shows apparatus for restricting or sealing a bore.

FIG. 1 shows apparatus for use in restricting or sealing a bore. A first expansion tool 1 is secured to a work string 3. The first expansion tool 1 has, towards its downhole end an inflatable bladder 5 and a reinforcing member 7 in the bladder. Also on the work string is a second expansion tool 9. The second expansion tool 9 has a longer bladder 11 and reinforcing member 13 than the first expansion tool 1. A straddle 15 is located around the work string, over the second expansion tool 9.

The method by which the apparatus shown in FIG. 1 is used to seal a bore 19 will now be described with reference to FIGS. 2 to 6.

Figure 2A:
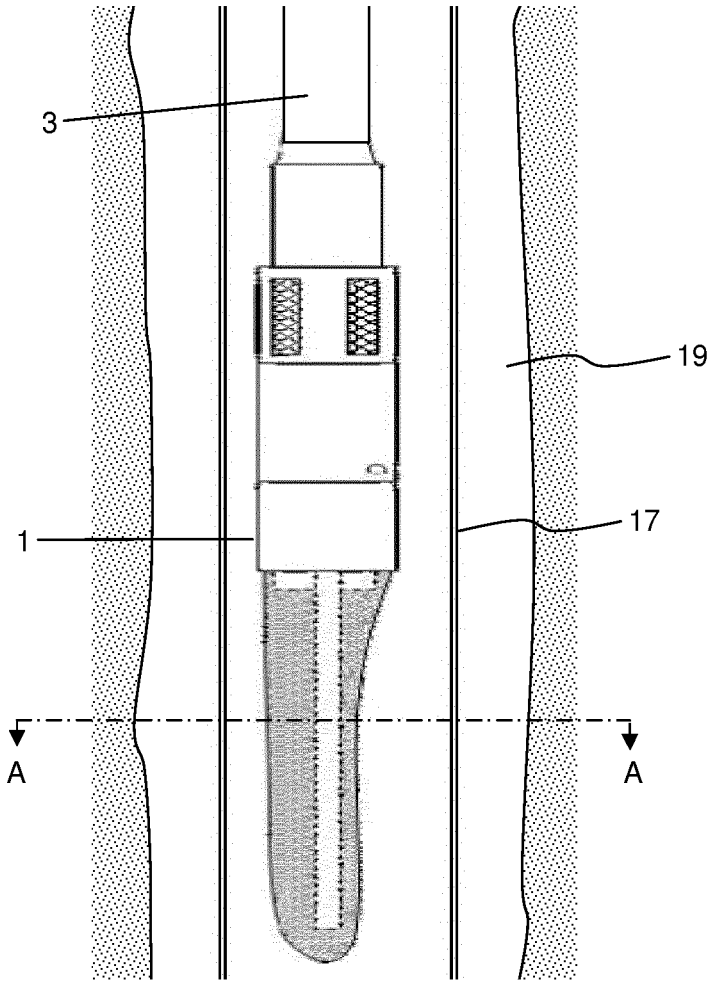
FIG. 2 shows a schematic (a) side view and (b) plan view along line A of an expansion tool at the end of a work string positioned in a tubular in a bore.
Figure 2B:
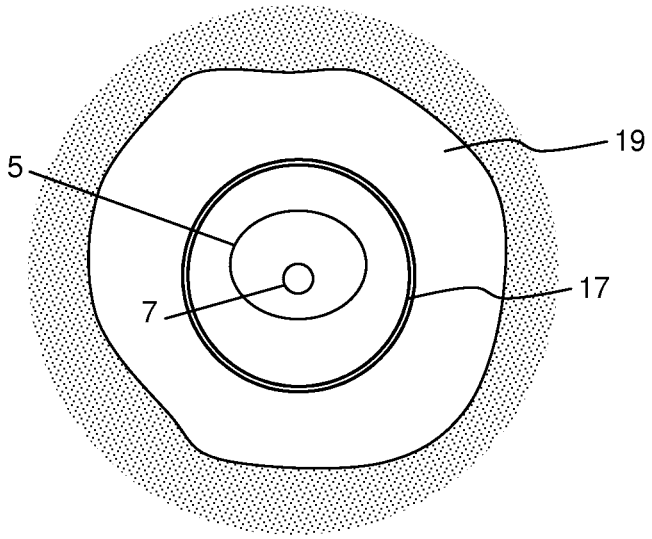

FIG. 2 shows a tubular 17 in an unlined bore 19, such as a wellbore extending into the earth to intersect a formation. The work string is run into the tubular so that the expansion tool 1 is positioned in the region of the bore to be sealed.

Figure 3A:
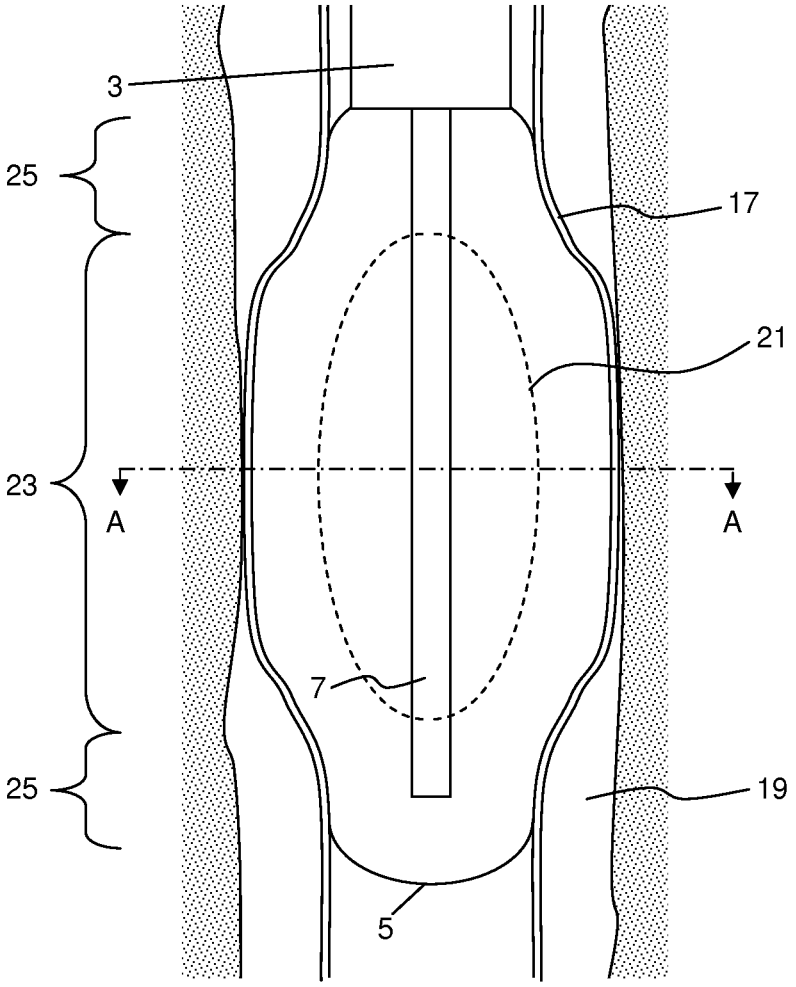
FIG. 3 shows a schematic (a) side view and (b) plan view along line A of the expansion tool with the bladder radially expanded, and the tubular expanded and split.
Figure 3B:
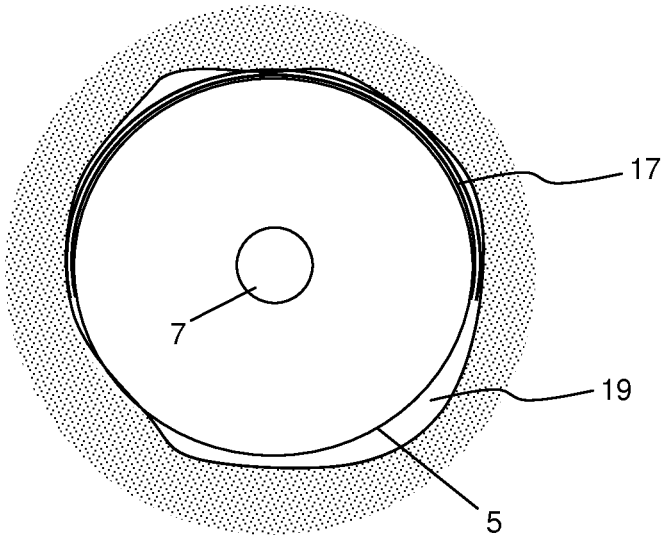

As shown in FIG. 3, the bladder 5 is then hydraulically radially expanded within the tubular 19, to cause the tubular to split. The split 21 extends generally axially along a length 23 of the tubular 17. The split region of the tubular is then extended towards and into engagement with the walls of the bore 19, under the action of the bladder. As best seen in FIG. 3(*b*), the walls of the split tubular 17 engage with the inner walls of the bore 19 and extend around approximately 60% of the circumference of the bore. Transitional regions 25 of the tubular, at either end of the region 23 which has been split, are expanded by the bladder 5.

Figure 4A:
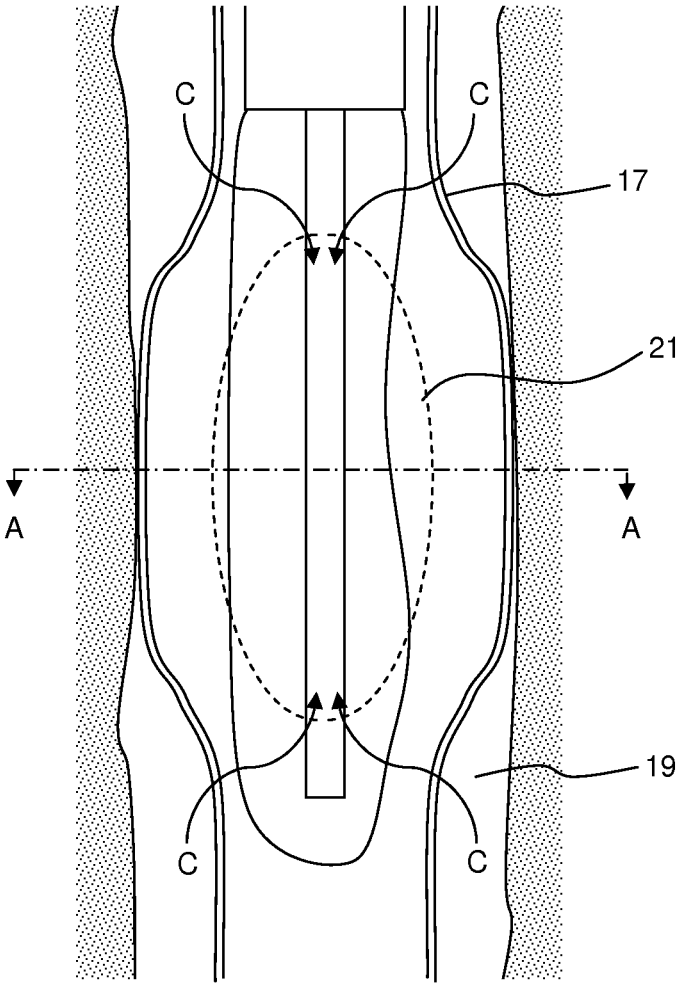
FIG. 4 shows a schematic (a) side view and (b) plan view along line A of the expansion tool with the bladder subsequently deflated, and the tubular expanded and split.
Figure 4B:
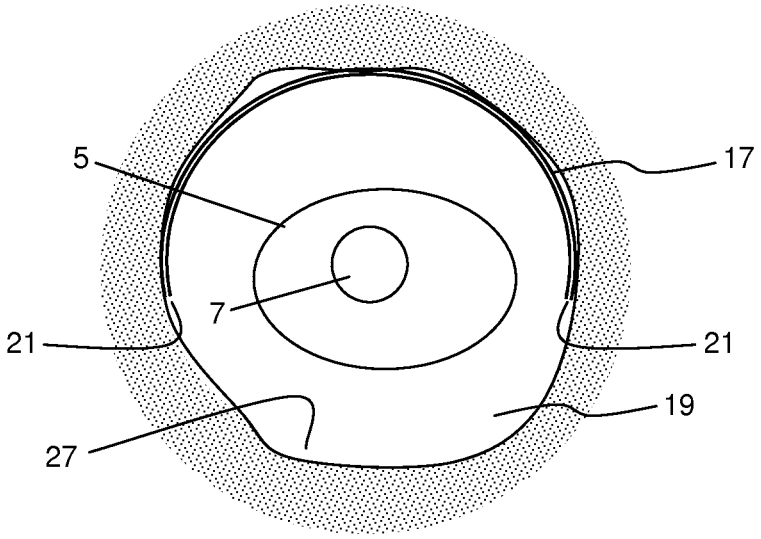

The bladder 5 of the first expansion tool 1 is then deflated, as shown in FIG. 4. An area 27 of the inner face of the bore 19, extending along the region of the tubular 23 which has been split, is open and fluid communication is possible between the bore and the inside of the tubular 17, as generally indicated in FIG. 4*a* by arrows C.

Figure 5A:
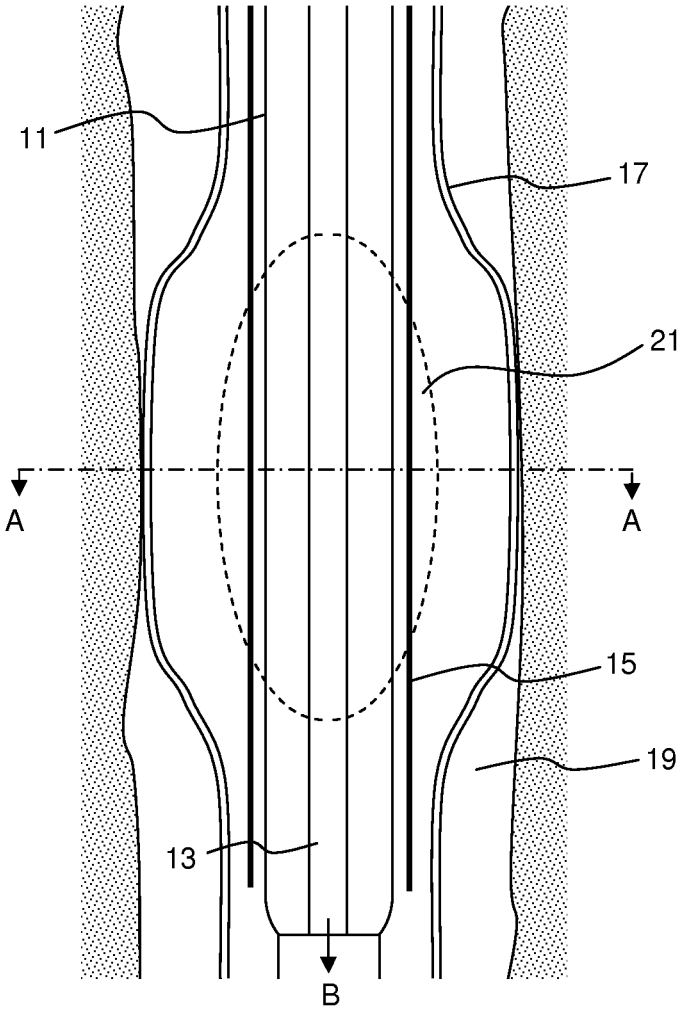
FIG. 5 shows a schematic (a) side view and (b) plan view along line A of a straddle located across the expanded and split tubular and positioned around a further expansion tool.
Figure 5B:
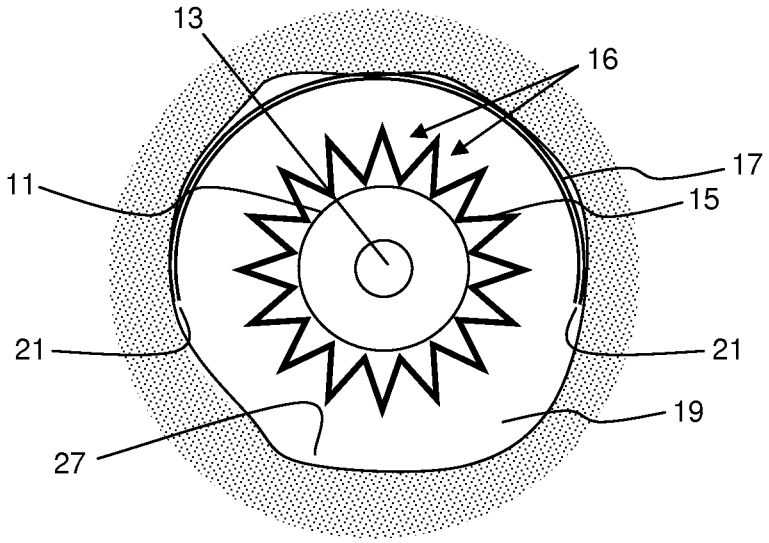

As shown in FIG. 5, the work string is then run further into the bore in direction B, so as to locate the straddle 15 within the tubular across the region 23 of the tubular which has been split. The straddle is provided with corrugations 16 running along its length, which are visible in cross section in FIG. 5(*b*).

Figure 6A:
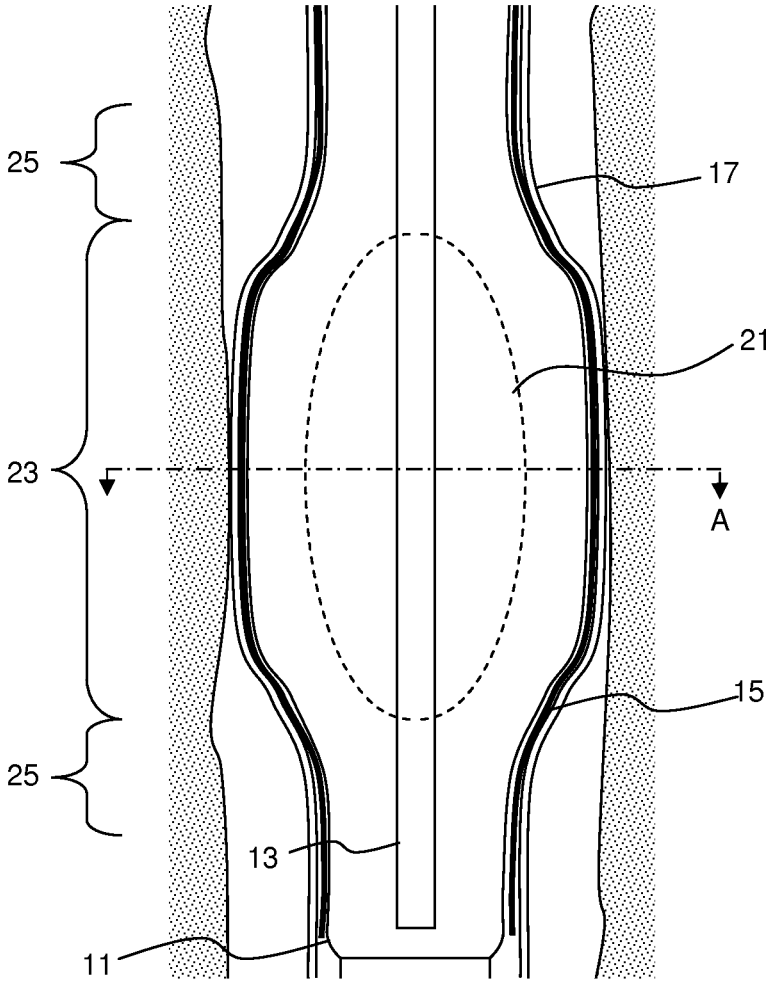
FIG. 6 shows a schematic (a) side view and (b) plan view along line A of the straddle expanded by the expansion tool to seal the split in the tubular.
Figure 6B:
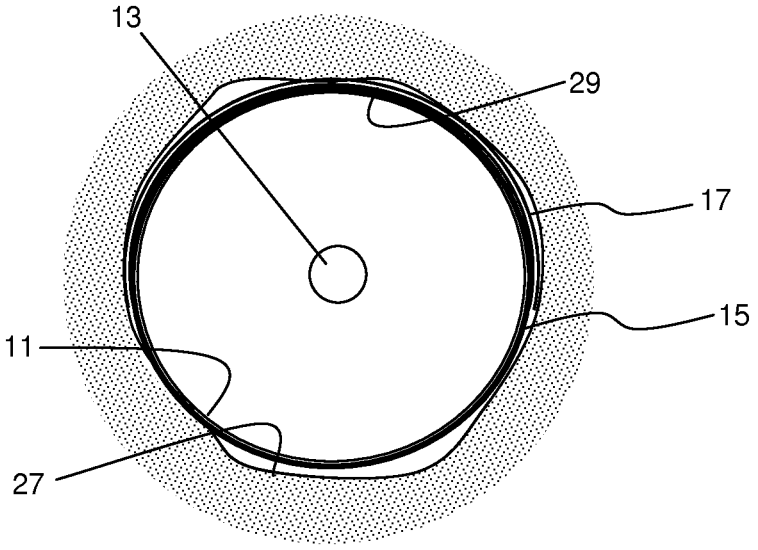
Figure 7A:
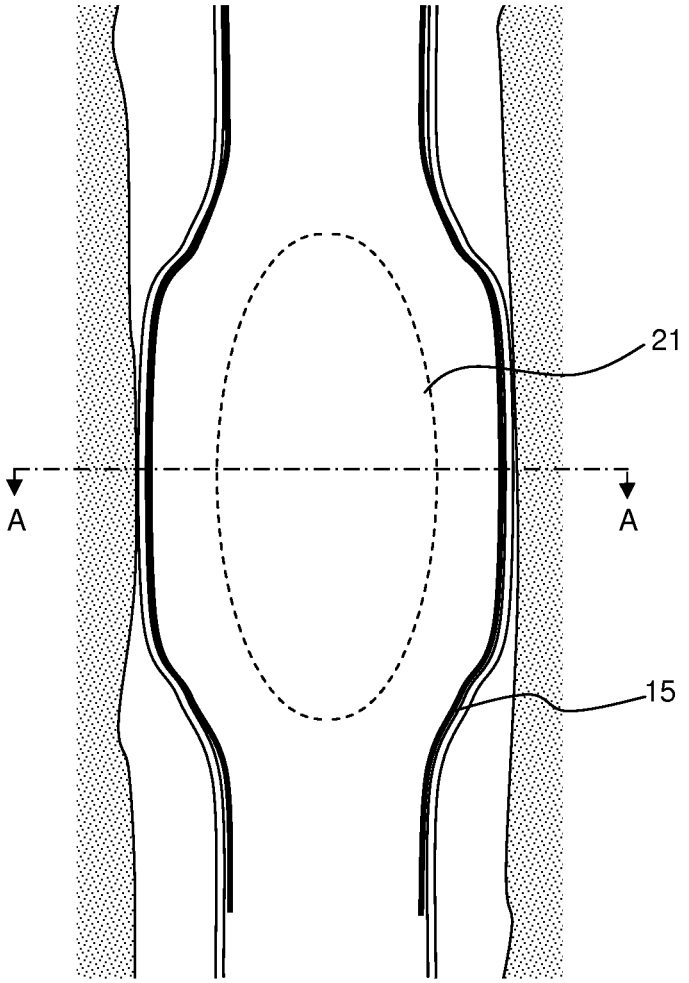
FIG. 7 shows a schematic (a) side view and (b) plan view along line A of the sealed tubular after the expansion tool has been removed.
Figure 7B:
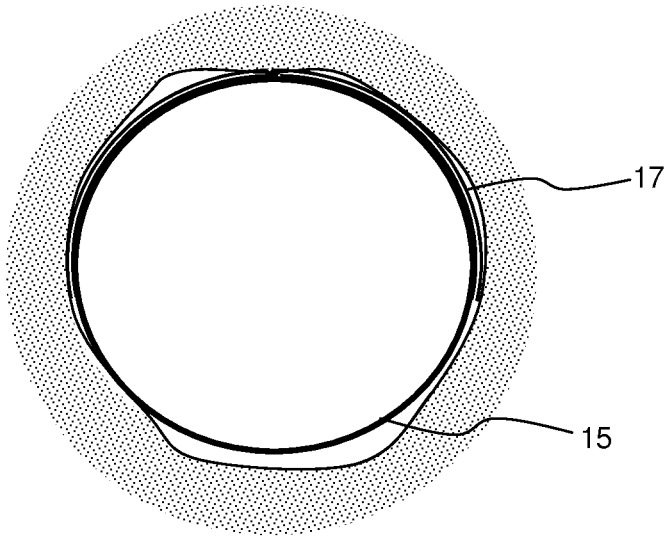

As shown in FIG. 6, the bladder 11 of the second expansion tool 9 is hydraulically expanded so as to expand the straddle 15 and seal the split in the tubular. As can be seen in FIG. 6*a*, the straddle 15 is expanded into engagement both with the transitional regions 25 and the split region 23 of the tubular 17. As can be seen in FIG. 6*b*, in the split region 23 of the tubular 17, the straddle 15 is expanded into engagement with both the inside face 29 of the tubular and the area 27 of the inner face of the bore 19. Thus, the straddle seals the split 21 in the tubular and the straddle and the expanded and split tubular together seal the bore. The bladder 11 of the second expansion tool 9 is then deflated and the work string recovered from the tubular (FIG. 7).

Figure 8A:
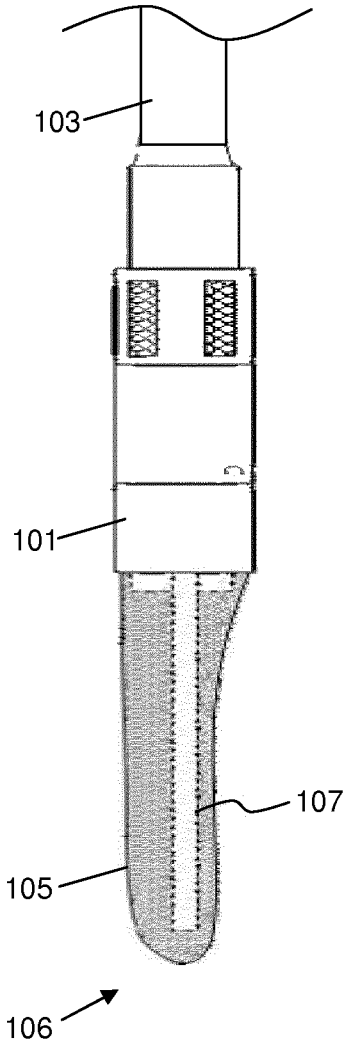
FIG. 8 shows an alternative embodiment of apparatus for restricting or sealing a bore, comprising (a) a first expansion tool and (b) a second expansion tool.
Figure 8B:
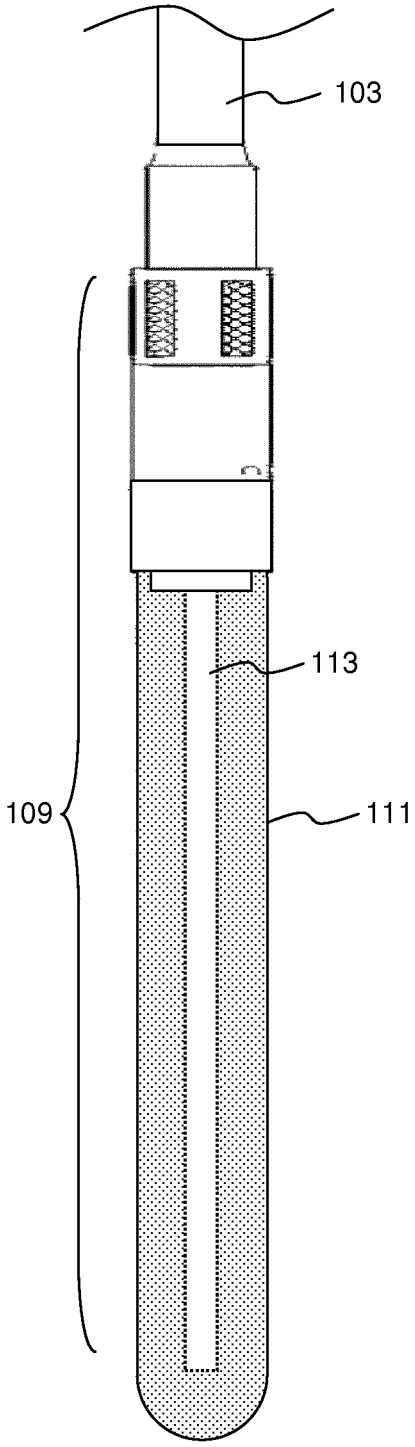

FIG. 8 shows an alternative embodiment of apparatus for use in restricting or sealing a bore. Features in common with the apparatus shown in FIGS. 1 to 7 are labelled with the same reference numerals, incremented by 100.

A first expansion tool 101 is secured to a work string 103 (FIG. 8(*a*)). The first expansion tool 101 has, towards its downhole end an inflatable bladder 105 and a reinforcing member 107 in the bladder. The first expansion tool 101 may be run into a tubular and used to expand and split the tubular, in the manner described above with reference to tool 1.

Figure 9:
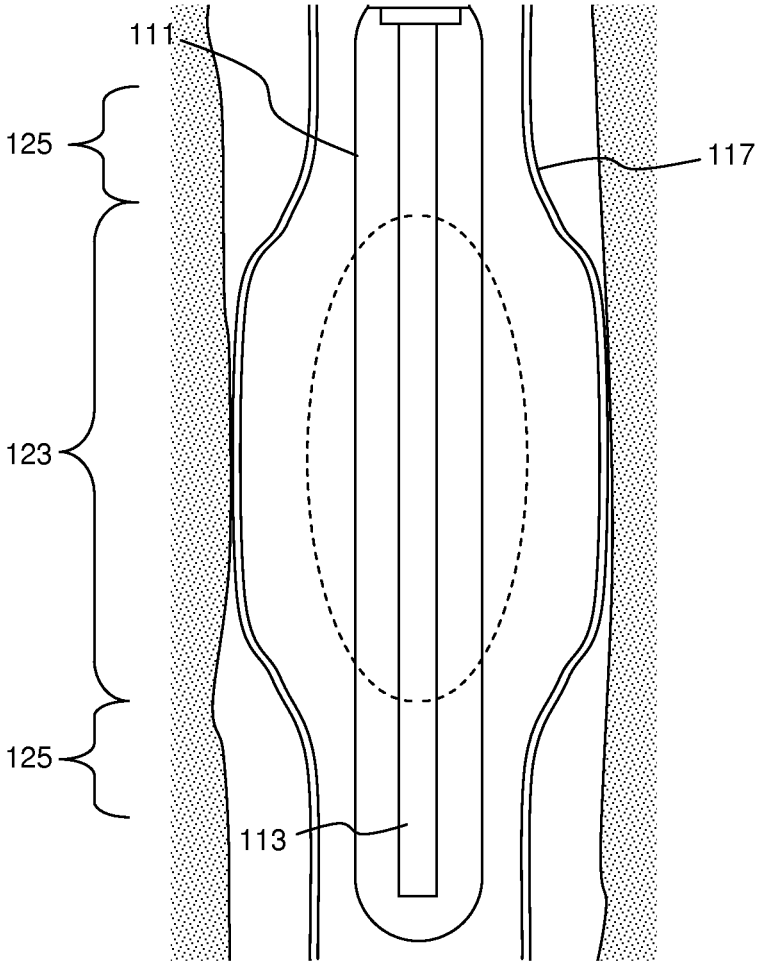
FIG. 9 shows a schematic side view of the second expansion tool of FIG. 8(*b*) positioned in a tubular across a region which has been expanded and split.

The first expansion tool 101 is then retrieved and a second expansion tool 109, having a bladder 111 and tubular reinforcing member 113 which are longer than those of the first expansion tool 101, is secured to the work string 103 (FIG. 8(*b*)). The second expansion tool is run into the tubular 117 and positioned as shown in FIG. 9, with the bladder 111 extending across the region of the tubular 123 which has been split and the transitional regions 125 which have been expended but not split.

Figure 10:
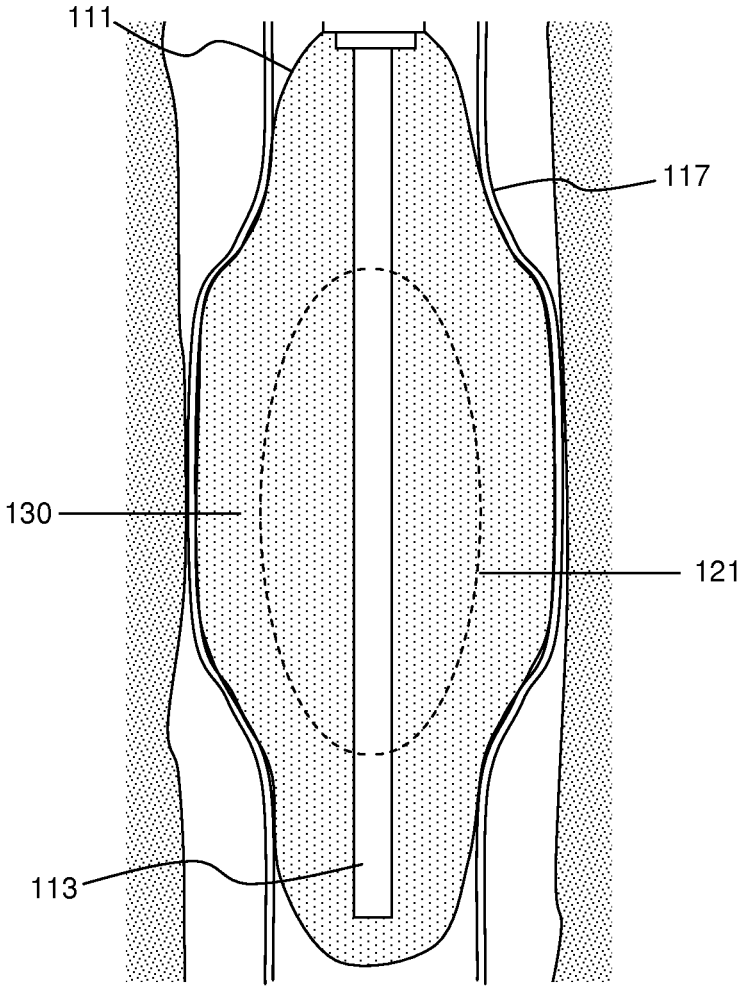
FIG. 10 shows a schematic side view of the second expansion tool used to seal the split tubular.
Figure 11:
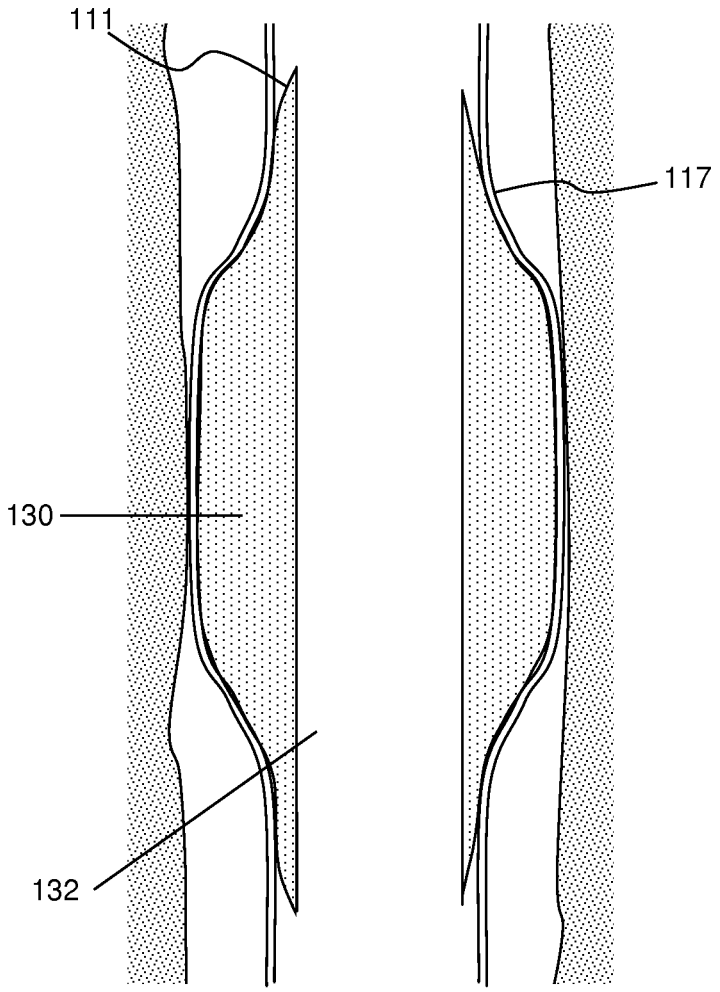
FIG. 11 shows a schematic side view of the sealed tubular, with a channel drilled through the second expansion tool.

As shown in FIG. 10, the bladder 111 is then expanded by injecting a settable medium 130 (such as epoxy) into the bladder through the tubular reinforcing member 113 and the settable medium allowed to set, so as to seal the split 121 in the tubular 117. The second expansion tool is then disconnected from the work string 103 and drilled through using a drill string (not shown) to establish a channel 132 through the tubular 117, as shown in FIG. 11. During drilling, the tubular reinforcing member 113 functions as a guide for the drill string.

In alternative embodiments, the method may be carried out using a single expansion tool. The straddle may be located in the region of a tubular which has been expanded and split by the expansion tool and released from a position around the work string above the expansion tool so that the expansion tool can be repositioned within the straddle and used to expand the straddle and seal the split in the tubular.

The method described above may be facilitated by use of a tubular which is adapted to preferentially split along a weak zone.

Figure 12:
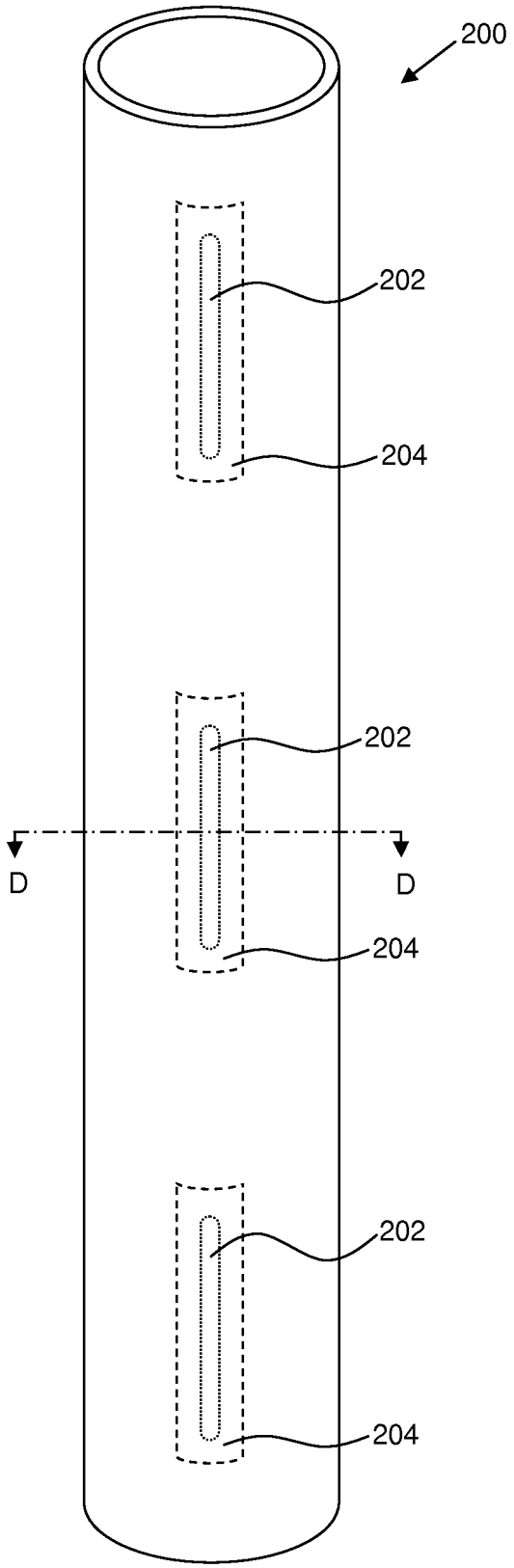
FIG. 12 shows a tubular provided with weak zones extending axially along its length.
Figure 13:
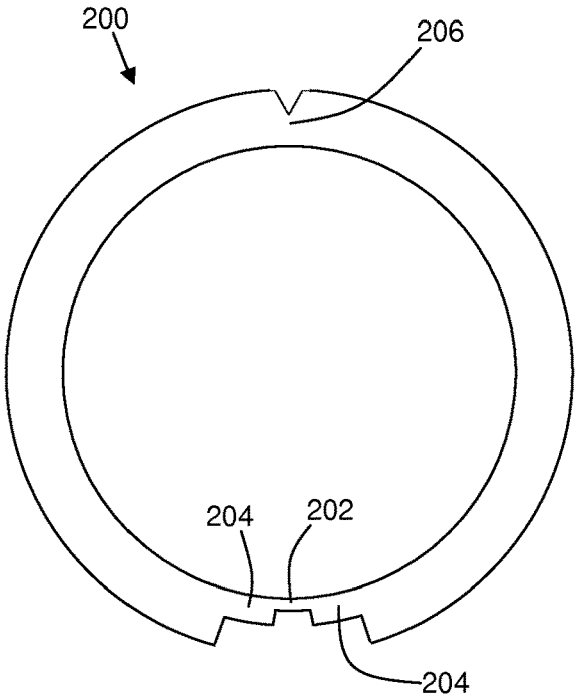
FIG. 13 shows a cross section of the tubular of FIG. 12 through line D.

A length of tubular 200 having a series of weak zones 202 is shown in FIG. 12. Each of the weak zones 202 are formed as a line which has been machined axially along the tubular, where the thickness of the wall of the tubular is reduced by 80% in comparison to the unmachined wall thickness (as can be seen in the cross sectional view of the tubular 200 of FIG. 13). The weak zones 202 are each surrounded by a further region 204 where the thickness of the wall is reduced by 60%. It will be understood that the wall thickness of the tubular at or around the weak zone 202 may be reduced by a different percentage. In an alternative embodiment (not shown), the weak zone is provided by drilling, abrasive jetting, perforating (e.g. with shaped charges), or chemical etching, etc. apparatus in run into the tubular, and thus alternatively extend from the internal face of the tubular, rather than from the external face as shown in FIGS. 12-14.

Extending along the length of the tubular and diametrically opposite the series of weak zones, is a predefined zone of deformation (not visible in FIG. 12). As can be seen in FIG. 13, the predefined zone of deformation 206 consists of a notch running axially along the tubular, extending to a depth of 30% of the thickness of the wall of the tubular 200.

Figure 14:
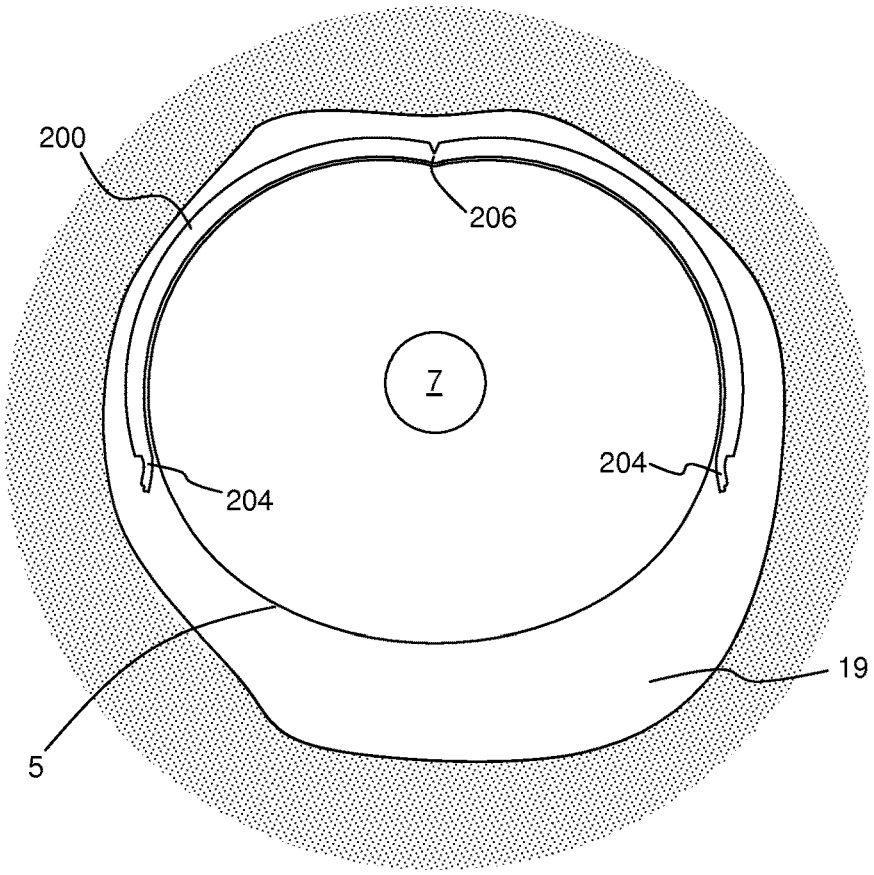
FIG. 14 shows a cross section of the tubular of FIG. 12 through line D, which has been expended and split by an expansion tool.

FIG. 14 shows the tubular 200 in a bore 19, having been expanded and split by the expansion tool 1 in the manner described above and during the process of being extended towards the walls of the bore. Under the action of an expansion tool in the method described above, the tubular 200 splits along a weak zone 202 in a predictable fashion. In addition, as the further region of reduced wall thickness 204 is weaker than the adjacent portions of the wall of the tubular. The regions 204 bend outwardly, such that the torn edges of the weak zone 202 face away from the bladder of the expansion tool. Thus, the tubular 200 is less prone to puncturing the bladder 5 of the expansion tool, in use.

As the tubular 200 is extended towards the wall of the bore (as described above) the walls of the tubular in the region of the tubular which has been split, preferentially bend around the predefined zone of deformation 206. This increases the degree to which the torn edges of the weak zone 202 face away from the bladder 5 of the expansion tool 1, and also facilitates extension of the tubular 200 towards the bore 19, as shown in FIG. 14.

A tubular having weak zones (e.g. production tubing) can be run into a bore and function normally and, as necessary (for example when water break through is detected) the apparatus shown in FIG. 1, which includes an expansion tool configured to expand the tubular and at least one straddle positioned around a further expansion tool, can be run into the bore and caused to split the tubular in a controlled fashion along one or more of the weak zones.

Figure 15:
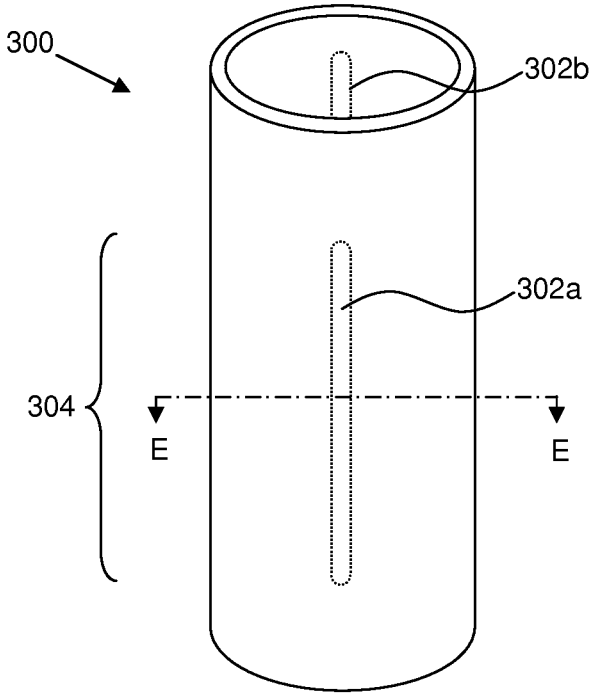
FIG. 15 shows a tubular provided with weak zones on diametrically opposite sides of the tubular.
Figure 16:
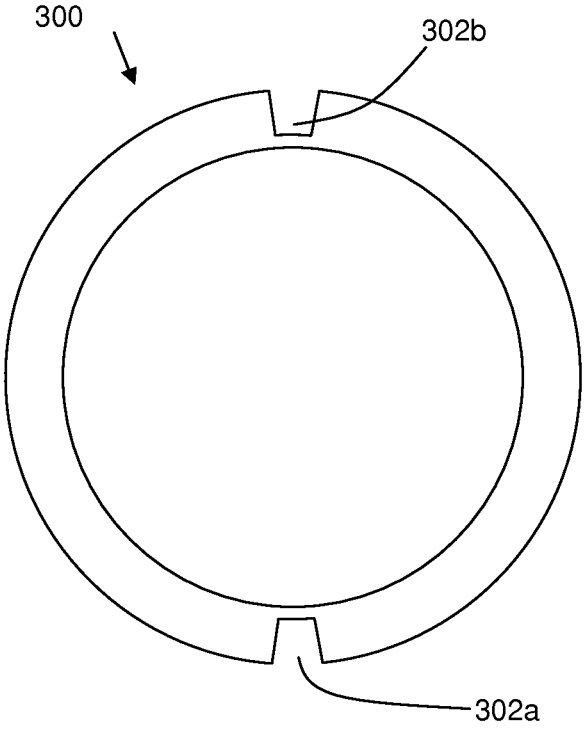
FIG. 16 shows a cross section of the tubular of FIG. 15, along line E.

FIG. 15 shoes a length of tubular 300, having circumferentially spaced apart weak zones 302*a* and 302*b*, on diametrically opposite sides of the tubular, along a length 304 of the tubular. FIG. 16 shoes a cross section of the tubular 300 along E. The weak zones 302*a,b* are regions of reduced wall thickness. In alternative embodiments (not shown) circumferentially spaced apart weak zones may comprise a series of perforations.

The weak zones 302*a* and 302*b* may be provided in situ, for example by a mechanical drill or grinder positioned on the work string, or by shaped charges. When the weak zones are created in situ, material will be taken away from the inside rather than the outside of the tubular.

Figure 17:
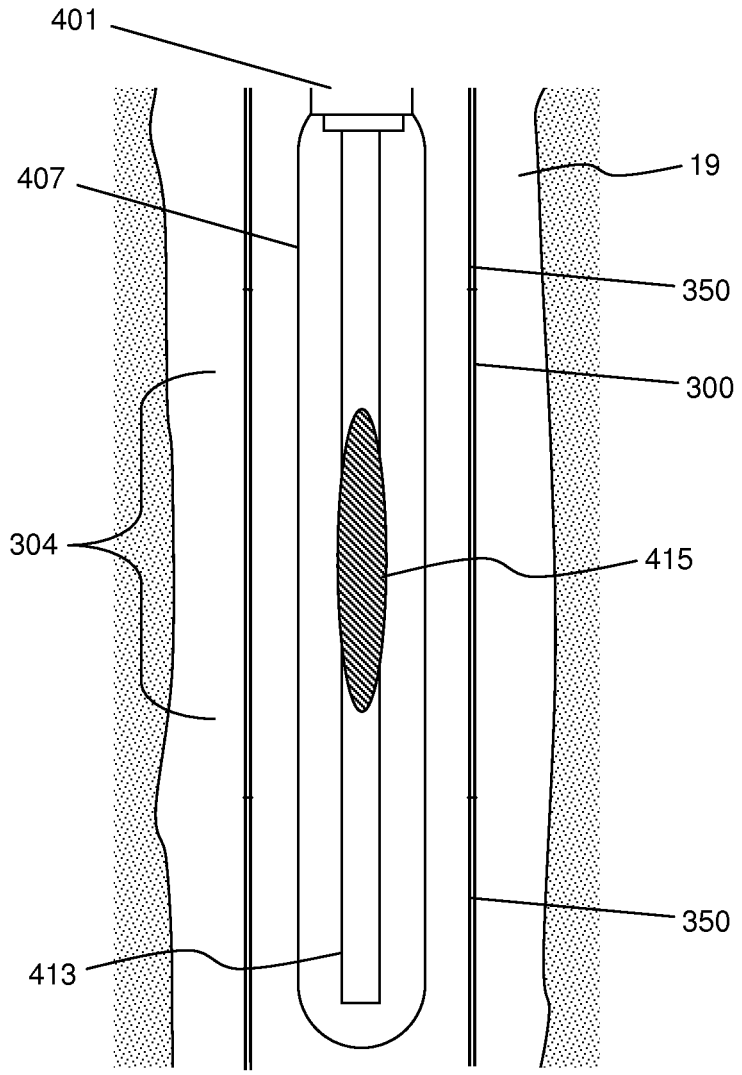
FIG. 17 shows an expansion tool having an explosive charge, positioned in a bore within a tubular as shown in FIG. 15.

FIG. 17 shows tubular 300, connected at each end to further tubulars 350, in an unlined bore 19. An expansion tool 401 connected to a work string (not shown) is located within the tubular 300. The expansion tool 401 has an inflatable bladder 407 and a support member 413 extending within the inflatable bladder. An explosive charge 415 is positioned around the support member 413.

Figure 18:
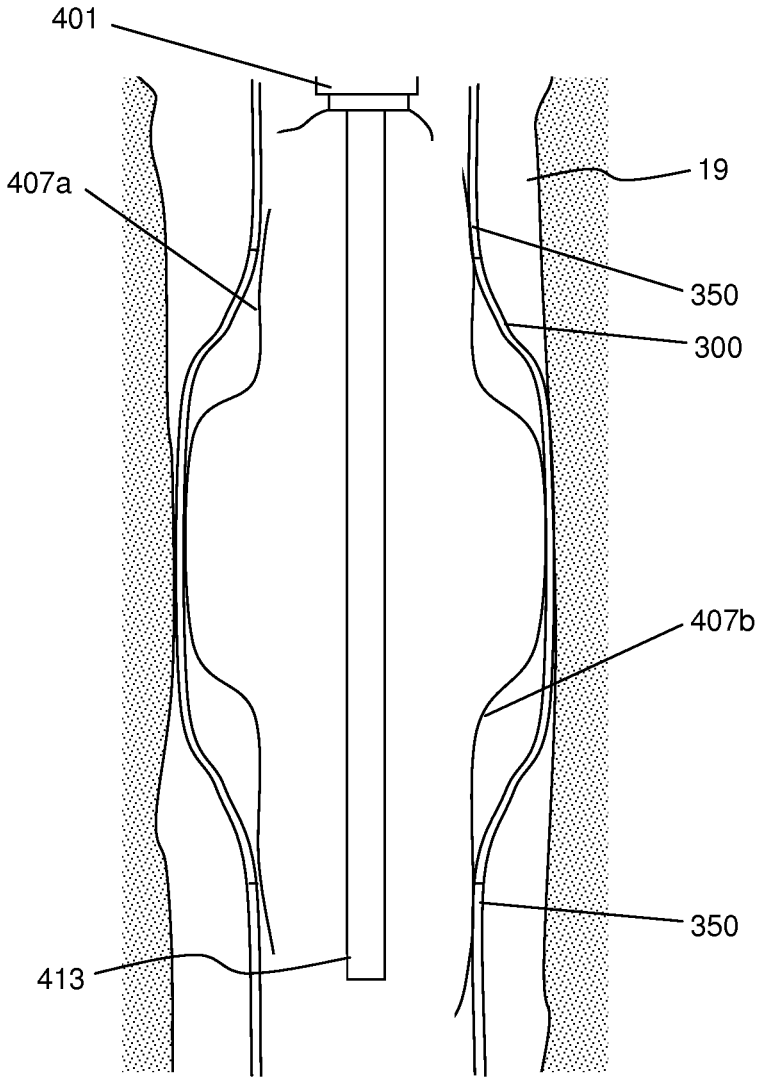
FIG. 18 shows the expansion tool and tubular of FIG. 17, following detonation of the explosive charge.

As shown in FIG. 18, the bladder 407 may be rapidly expanded by detonating the explosive charge 415, which causes the tubular 300 to split along the weak zones 302*a* and 302*b* (which are shown in FIGS. 15 and 16) and expand into engagement with the bore. Detonation of the explosive charge may causes the bladder 407 to rupture into one or more portions 407*a,b*. The tool 401 may then be removed.

A second expansion tool may then be run into the bore together with a straddle, so as to expand the straddle and seal the split tubular in the manner described above, with reference to FIGS. 5-11.

In alternative embodiments (not shown) the tubular may expand, split and break into fragments along the length of the tubular 300, and forced outwardly into engagement with the bore wall by the expanding bladder. The portion(s) 407*a,b* of the ruptured bladder may then remain in the bore 19 following removal of the tool 401, positioned so as to bridge between the fragments and the remainder of the tubular, and retain the fragments in position, so as to prevent them from falling into the bore or into the tubular.

The invention claimed is:

1. A method for use in sealing a bore, comprising;

providing a predefined frangible weak zone in a tubular which is located in the bore, the weak zone including a region of reduced wall thickness in the tubular;

expanding the tubular to cause the tubular to fracture in a region of the predefined frangible weak zone and be extended towards a wall of the bore;

subsequently locating a straddle within the tubular which extends across the region of the tubular which has been fractured; and expanding the straddle, such that at least one of the straddle and the fractured tubular is expanded into engagement with the wall of the bore so as to seal the fracture in the tubular.

2. The method according to claim 1, wherein the expanding the tubular includes causing the tubular to fracture and be extended into engagement with a wall of the bore.

3. The method according to claim 1, wherein the bore is defined by a further tubular or the bore is defined by an open hole.

4. The method according to claim 1, further comprising:

locating an expansion tool within the tubular and wherein the expanding the tubular includes using the expansion tool to expand and fracture the tubular.

5. The method according to claim 4, wherein the expansion tool comprises a bladder and the expanding the tubular comprises inflating the bladder.

6. The method according to claim 4, wherein the expansion tool comprises an explosive charge, and the expanding the tubular comprises detonating the explosive charge to expand and fracture the tubular.

7. The method according to claim 1, further comprising locating a straddle positioned around an expansion tool and wherein the expanding the straddle includes using the expansion tool to expand the straddle and seal the fracture in the tubular.

8. The method according to claim 1, comprising weakening a zone of the tubular, and subsequently fracturing the tubular along the weak zone.

9. The method according to claim 8, comprising weakening a zone of the tubular in situ.

10. The apparatus according to claim 1, wherein the predefined frangible weak zone is provided in the tubular prior to insertion in the bore.

11. An apparatus for use in sealing a bore, the apparatus comprising:

an expansion tool configured to be positioned within a tubular located in the bore, configured to expand the tubular, and to cause the tubular to fracture in a predefined frangible weak zone and be extended towards a wall of the bore, the weak zone including a region of reduced wall thickness in the tubular; and a straddle configured to be positioned within the tubular and to extend across a region of the tubular fractured by the expansion tool, the straddle configured to be subsequently radially expanded by an expansion tool to seal a fracture in the tubular, such that at least one of the straddle and the fractured tubular is expanded into engagement with the wall of the bore, such that the bore is sealed.

12. The apparatus according to claim 11, comprising a first expansion tool configured to expand the tubular; and to cause the tubular to fracture and be extended towards a wall of the bore; and a second expansion tool configured to radially expand the straddle.

13. An apparatus for use in sealing a bore, the apparatus comprising:

a tubular having a predefined frangible weak zone extending axially along at least a part of a length of the tubular, the frangible weak zone configured to fracture under action of an expansion tool such that the tubular may be extended towards a wall of the bore, wherein the weak zone includes a region of reduced wall thickness in the tubular; and a radially expandable straddle positionable within the tubular, the straddle configured to extend across a region of the tubular fracture by the expansion tool, the straddle configured to be subsequently radially expanded by an expansion tool to seal a fracture in the tubular, such that at least one of the straddle and the fractured tubular is expanded into engagement with the wall of the bore, such that the bore is sealed.

14. The apparatus according to claim 13, wherein the frangible weak zone of the tubular comprises at least one of a region of reduced wall thickness and a series of perforations.

15. The apparatus according to claim 13, comprising a predefined zone of deformation extending along at least a part of the length of the tubular, the predefined zone of deformation configured to bend when the tubular has been fractured and is further expanded, under the action of an expansion tool.

16. The apparatus according to claim 15, wherein the predefined zone of deformation and predefined frangible weak zone are diametrically opposite each other along at least a part of the length of the tubular.

17. The apparatus according to claim 13, comprising two predefined frangible weak zones diametrically opposite each other along at least a part of the length of the tubular.

18. A method for use in sealing a bore, comprising:

providing a predefined frangible weak zone in a tubular which is located in the bore;

expanding the tubular so as to cause the tubular to fracture into fragments in a region of the predefined frangible weak zone and to cause the fragments towards a wall of the bore;

subsequently locating a straddle within the tubular which extends across the region of the tubular which has been fractured; and expanding the straddle, such that the straddle, the fragments, or both the straddle and the fragments is expanded into engagement with the wall of the bore so as to seal the fracture in the tubular.

19. The method of claim 18, further comprising:

retaining the fragments in engagement with the wall.

20. An apparatus for use in sealing a bore, the apparatus comprising:

an expansion tool configured to be positioned within a tubular located in the bore, and configured to expand the tubular; and to cause the tubular to fracture into fragments in a predefined frangible weak zone and be extended towards a wall of the bore, the weak zone comprising a region of reduced wall thickness in the tubular; and a straddle configured to be positioned within the tubular and to extend across a region of the tubular fractured by the expansion tool, the straddle configured to be subsequently radially expanded by an expansion tool to seal a fracture in the tubular, such that the straddle, the fragments, or both the straddle and the fragments of the fractured tubular is expanded to into engagement with the wall of the bore, such that the bore is sealed.

21. The apparatus of claim 20, wherein the straddle is configured to retain the fragments in engagement with the wall.

22. Apparatus for use in sealing a bore, the apparatus comprising:

a tubular having a predefined frangible weak zone extending axially along at least a part of a length of the tubular, the frangible weak zone configured to fracture into fragments under action of an expansion tool such that the tubular may be extended towards a wall of the bore; and a radially expandable straddle positionable within the tubular, the straddle configured to extend across a region of the tubular fracture by the expansion tool, the straddle configured to be subsequently radially expanded by an expansion tool to seal a fracture in the tubular, such that the straddle, the fragments, or both the straddle and the fragments of the fractured tubular is expanded into engagement with the wall of the bore, such that the bore is sealed.

23. The apparatus of claim 22, wherein the straddle is configured to be radially expanded by the expansion tool such that the fragments are retained in engagement with the wall.

* * * * *